US008807969B2

(12) United States Patent
Chang et al.

(10) Patent No.: US 8,807,969 B2
(45) Date of Patent: Aug. 19, 2014

(54) FAN ASSEMBLY

(75) Inventors: Shun-Chen Chang, Taoyuan Hsien (TW); Chia-Ming Hsu, Taoyuan Hsien (TW); Bo-Chun Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 105 days.

(21) Appl. No.: 13/282,981

(22) Filed: Oct. 27, 2011

(65) Prior Publication Data

US 2012/0107091 A1 May 3, 2012

(30) Foreign Application Priority Data

Nov. 1, 2010 (TW) ..... 99137396 A

(51) Int. Cl.

| | |
|---|---|
| ***F04D 25/06*** | (2006.01) |
| ***F04D 25/16*** | (2006.01) |
| ***F04D 19/02*** | (2006.01) |
| ***F04D 25/12*** | (2006.01) |

(52) U.S. Cl.

CPC ..... *F04D 19/022* (2013.01); *F04D 25/0613* (2013.01); *F04D 19/026* (2013.01); *F04D 25/12* (2013.01)

USPC ..... 417/423.5; 417/353

(58) Field of Classification Search

USPC ..... 417/244, 245, 405, 423.5, 349, 352, 417/353, 354, 391, 424.1; 415/66, 68, 69; 416/120, 124, 126

See application file for complete search history.

(56) References Cited

U.S. PATENT DOCUMENTS

| | | | | |
|---|---|---|---|---|
| 6,591,873 | B1 * | 7/2003 | McNeil | 141/4 |
| 6,916,160 | B2 * | 7/2005 | Obara | 417/354 |
| 2002/0090308 | A1 * | 7/2002 | Cheng | 417/423.1 |
| 2005/0084384 | A1 * | 4/2005 | Delano et al. | 417/42 |
| 2006/0239838 | A1 * | 10/2006 | Rahbar et al. | 417/354 |
| 2007/0207044 | A1 * | 9/2007 | Nagamitsu et al. | 417/354 |
| 2009/0245998 | A1 * | 10/2009 | Guemmer | 415/66 |
| 2011/0223042 | A1 * | 9/2011 | Chang et al. | 417/313 |

* cited by examiner

*Primary Examiner* — Bryan Lettman

(74) *Attorney, Agent, or Firm* — Muncy, Geissler, Olds & Lowe, P.C.

(57) ABSTRACT

A fan assembly includes a housing, a first frame, a second frame, at least one driving device, a supporting device, an active impeller and a passive impeller. The housing has an air-flowing channel, and the first frame and second frame are disposed at opposite sites of the air-flowing channel. The driving device is disposed on the first frame and actuates the active impeller to rotate. The supporting device is disposed on the second frame and has the passive impeller thereon. The passive impeller is propelled by the airflow generated by the active impeller.

21 Claims, 11 Drawing Sheets

FAN ASSEMBLY

CROSS REFERENCE TO RELATED APPLICATIONS

This application claims priority of Taiwan Patent Application No. 099137396, filed on Nov. 1, 2010, the entirety of which is incorporated by reference herein.

BACKGROUND OF THE INVENTION

1. Field of the Invention

The present invention relates to a fan assembly, and in particular relates to an aerodynamic fan assembly which effectively enhances wind energy utilization efficiency.

2. Description of the Related Art

Referring to FIG. 1, a conventional fan includes a rotor 12, a stator 11, and an impeller 14. The rotor 12 is pivoted on a base 13. While the fan operates, due to interacting magnetic fields the rotor 12 is actuated by the stator 11 to rotate the impeller 14, and an airflow is generated through rotation of the blades of the impeller 14.

For the above-described conventional fan, in order to create more airflow, a larger sized impeller is typically used; however, at least two problems are produced:

First, in order to actuate the larger sized impeller, a heavier rotor and a larger actuating system is needed, which produces more torque for the larger sized impeller. Thus, the fan becomes heavy and costs rise. Second, resulting from the increased size of the fan, the rotating speed of the fan is restricted causing the actuating system to work less efficient and consume more energy.

BRIEF SUMMARY OF THE INVENTION

To enhance energy utilization efficiency of a fan with a large size, the invention provides a fan assembly. By utilizing aerodynamicist theory, the fan assembly of the invention successfully increases utilization of energy efficiency. Additionally, the durability, functionality, and maintenance of the fan assembly of the invention are also concerned.

One of the subjects of the invention is to provide a fan assembly including a housing, a first frame, a second frame, at least one driving device, a supporting device, an active impeller and a passive impeller. The housing has an air-flowing channel therein, and the first frame and second frame are disposed at opposite sites of the air-flowing channel. The driving device is disposed on the first frame and actuates the active impeller, and the supporting device is disposed on the second frame. The passive impeller is propelled by the airflow generated by the active impeller.

The passive impeller further includes a plurality of second passive blades encircling the first passive blades, and the passive impeller further includes a first airflow guiding ring disposed between the first passive blades and the second passive blades to connect the first passive blades to the second passive blades, wherein the first passive blades are connected to an inner wall of the first airflow guiding ring and the second passive blades are connected to an outer wall of the first airflow guiding ring. An accommodating space is formed by the inner wall of the first airflow guiding ring, and at least a portion of the active blades are inserted into the accommodating space, and the inner wall of the first airflow guiding ring is preferably parallel to or inclined with respect to an axis, wherein the axis is perpendicular to a rotating plane of the active impeller and substantially parallel to an extending direction of the air-flowing channel.

The active impeller can include a second airflow guiding ring encircling the outer edges of the active blades. Preferably, the second hub, the first passive blades, the second passive blades, and the first airflow guiding ring are integrally formed as a single piece. The active blades and the first passive blades correspond to each other in the axial direction, and the second passive blades encircle radially the first passive blades. The passive impeller can further include an enforcing ring encircling the outer edges of the second passive blades. A direction of the airflow generated by the second passive blades is different than or the same as a direction of the airflow generated by the active blades. Each of the first passive blades is overlapped by a neighboring first passive blade in the axial direction.

The fan assembly of the invention further includes a plurality of driving devices, combined in series, and a plurality of active impellers, wherein each of the driving devices has an independent active impeller disposed thereon, and wherein the first frame is preferably disposed between the driving devices. The housing can include a chamber for receiving at least one electronic element. The fan assembly can include a sensor, disposed on the supporting device, for detecting a rotating speed of the passive impeller or a current speed of the airflow generated by the passive impeller.

The driving device includes a first base, a circuit board, a stator, a first shaft, a magnetic component, and at least one first bearing, wherein the active blades are disposed on an outer wall of the first hub, the magnetic component is disposed on an inner wall of the first hub, the first shaft and the first bearing are disposed in a space constructed by the first hub and the first base, and the first base is fixed to the first frame by screw arrangement.

The supporting device includes a second base, a second shaft, and at least one second bearing, wherein the first passive blades are disposed on an outer wall of the second hub, and the second shaft and at least one of the second bearings are disposed in a space constructed by the second hub and the second base, and the second base is fixed to the second frame by screw arrangement.

A gap is constituted between the active impeller and the passive impeller resulting in no connection between the active impeller and the passive impeller. The first frame or the second frame is fixed to the housing by screw arrangement. The first frame or the second frame is a protective cover, a rib, or stator blades. Each of the active blades and each of the first passive blades respectively has a concave surface and a convex surface on opposite sites, and the concave surface of the active blades face the concave surface of the first passive blades. A rotating direction of the active blades is the same as that of the first passive blades.

Thus, the invention provides a fan assembly wherein the passive impeller is propelled by the airflow generated by the active impeller rather than an electric motor.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

To solve the problems of conventional fans, the present invention provides a fan assembly having a light weight to make an actuating system of the fan assembly work at high efficiency. A detailed description is given in the following embodiments with reference to the accompanying drawings.

Figure 1:
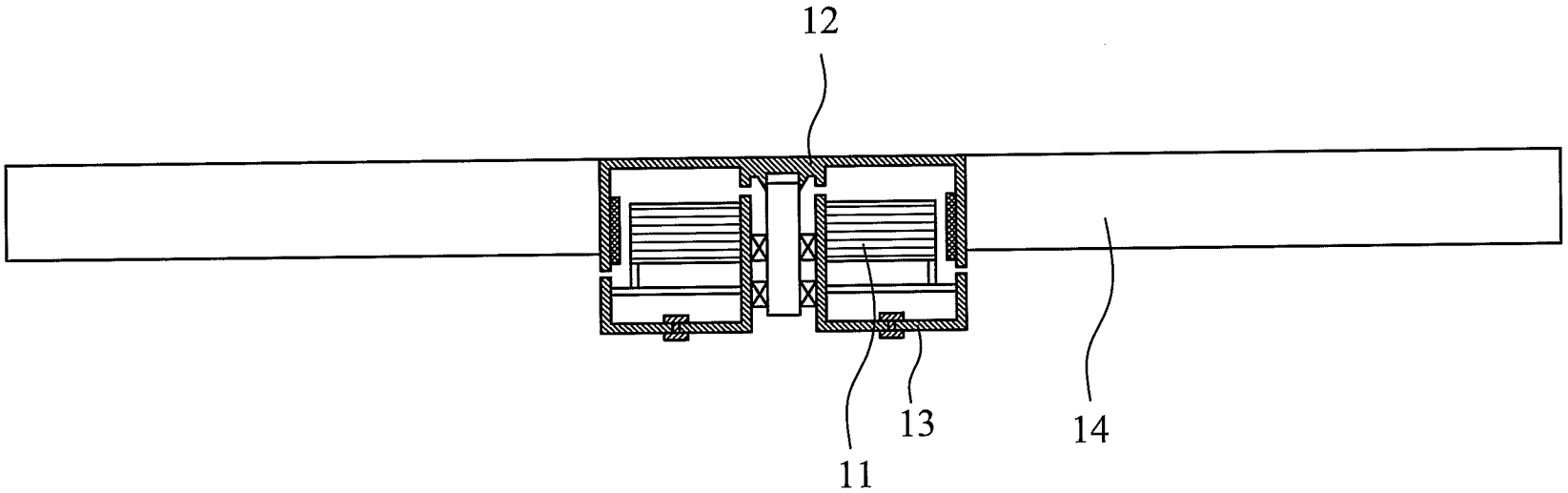
FIG. 1 ( PRIOR ART )
FIG. 1 is a schematic view of a conventional fan.
Figure 2:
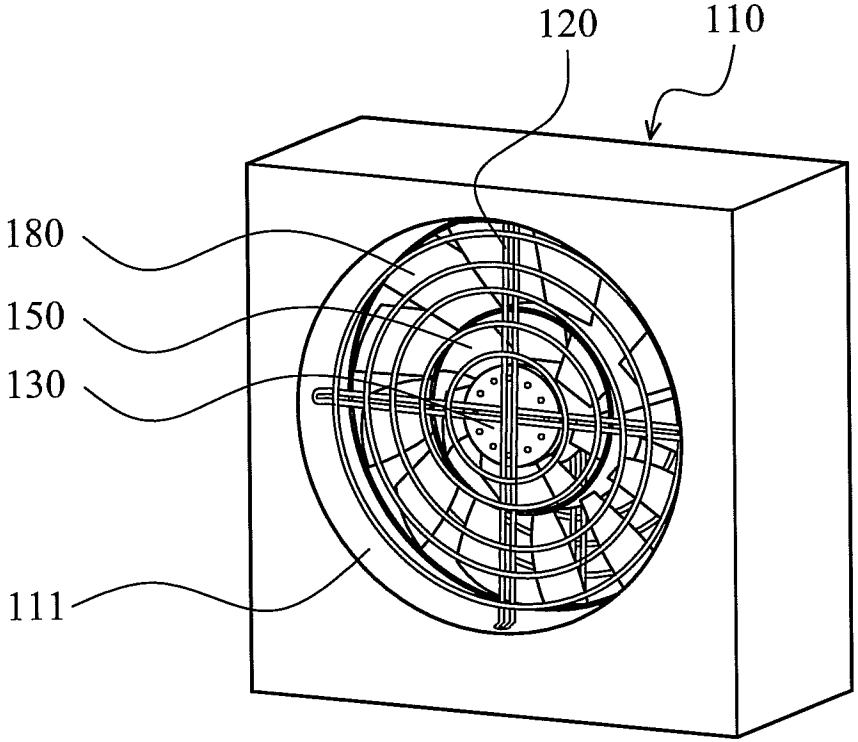
FIG. 2 is a schematic view of a fan assembly of a first embodiment of the invention.
Figure 3A:
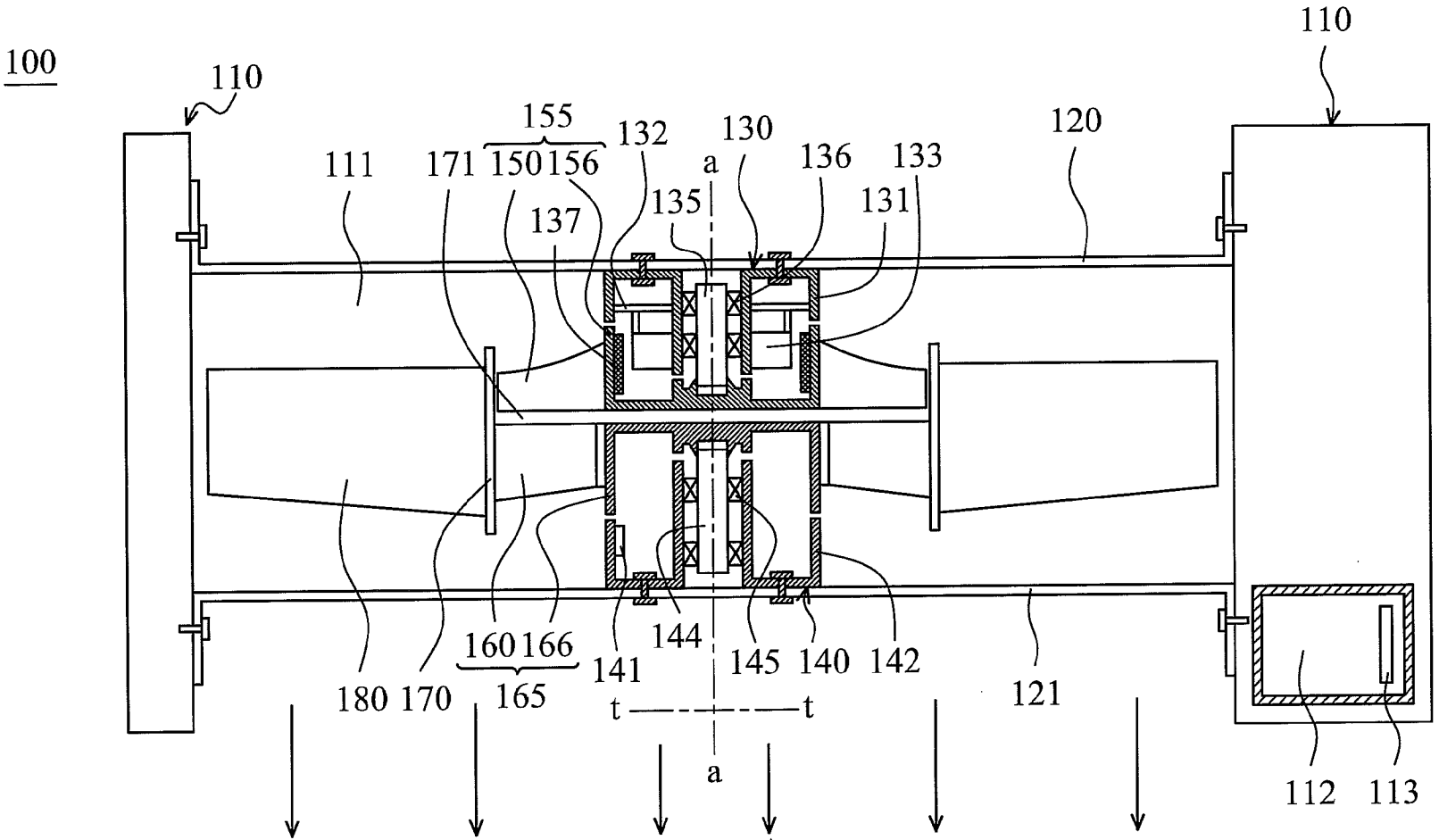
FIGS. 3A-3B are sectional schematic views of the fan assembly of the first embodiment of the invention.

Referring to FIGS. 2 and 3A, FIG. 2 is a schematic view of the first embodiment of a fan assembly 100 of the invention, and FIG. 3A is a sectional schematic view of the fan assembly 100 of the first embodiment of the invention. In this embodiment, the fan assembly 100 includes a housing 110, a first frame 120, a second frame 121, a driving device 130, a supporting device 140, an active impeller 155, a passive impeller 165, a first airflow guiding ring 170, and a plurality of second passive blades 180.

The housing 110 has an air-flowing channel 111 penetrating through a substantially central portion thereof, and a chamber 112 is disposed therein for receiving at least one electronic element 113. The first frame 120 is disposed at one end of the air-flowing channel 111, and the second frame 121, opposite to the first frame 120, is disposed at another end of the air-flowing channel 111. The first frame 120 and the second frame 121 are fixed to the housing 110 by screw arrangement. In this embodiment, the first frame 120 and the second frame 121 is a protective cover, but it is not to be limited, the first frame 120 and the second frame 121 can be a rib, or stator blades.

The active impeller 155 includes a plurality of active blades 150 and a first hub 156. The passive impeller 165 includes a plurality of first passive blades 160 and a second hub 166. The active blades 150 are disposed on an outer wall of the first hub 156, and the first passive blades 160 are disposed on an outer wall of the second hub 166, wherein the active blades 150 and the first passive blades 160 correspond to each other in an axial direction.

The driving device 130, providing power for the fan assembly 100, is disposed on the first frame 120. The driving device 130 includes a first base 131, a circuit board 132, a stator 133, a first shaft 135, at least one first bearing 136, and a magnetic component 137. The magnetic component 137 is disposed on an inner wall of the first hub 156, the first shaft 135 and the first bearing 136 are disposed in a space constructed by the first hub 156 and the first base 131, and the first base 131 is fixed to the first frame 120 by screw arrangement.

The supporting device 140, corresponding to the driving device 130, is disposed on the second frame 121. It is noted that there is no stator structure or other components of a motor in the supporting device 140. The supporting device 140 includes a second base 142, a second shaft 144, and two second bearings 145. The second shaft 144 and the second bearings 145 are disposed in a space constructed by the second hub 166 and the second base 142, and the second base 142 is fixed to the second frame 121 by screw arrangement. In addition, a sensor 141 is disposed on the supporting device 140.

The active impeller 155 and the passive impeller 165 are disposed along an axis a, and a gap is constituted between the active impeller 155 and the passive impeller 165 resulting in no connection therebetween, wherein the axis a is perpendicular to a rotating plane of the active impeller 155 and substantially parallel to an extending direction of the airflowing channel 111. The driving device 130 actuates the active impeller 155 to rotate, and the passive impeller 165 is disposed on the supporting device 140. The sensor 141, disposed on the supporting device 141, is used to detect a rotating speed of the passive impeller 165 or a current speed of the airflow generated by the passive impeller 165, so as to monitor an operational status of the fan assembly of the invention.

Figure 4:
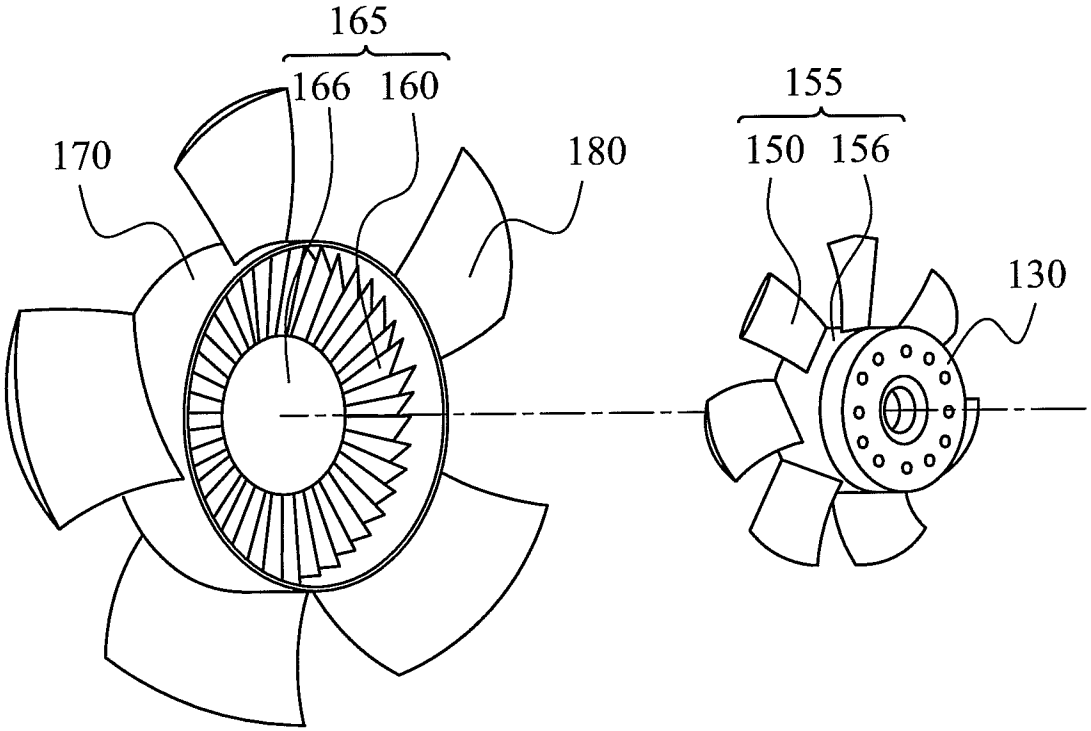
FIG. 4 is a partially exploded view of the fan assembly of the first embodiment of the invention.
Figure 5:
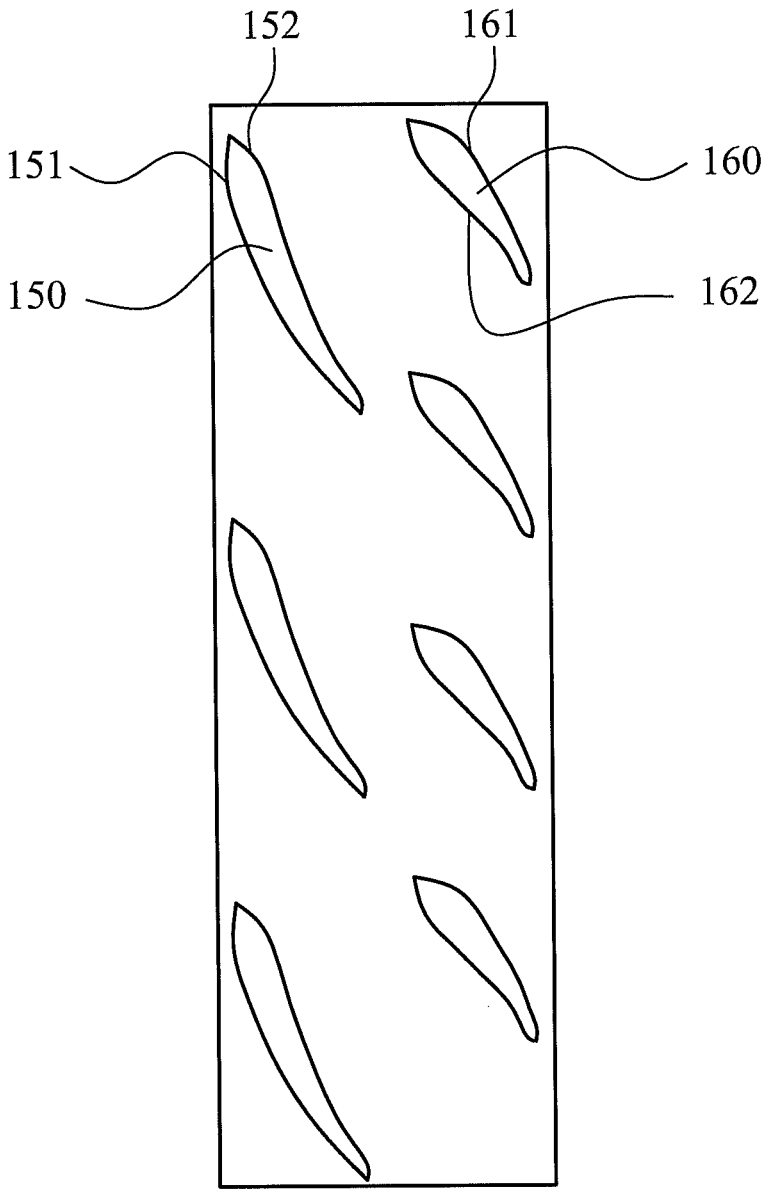
FIG. 5 is a schematic view of blade structures of the fan assembly of the first embodiment of the invention.

Referring to FIG. 4, an exploded view of the active impeller 155 and the passive impeller 165 of the fan assembly 100 is illustrated. The passive impeller 165 further includes a first airflow guiding ring 170 and a plurality of second passive blades 180. The first airflow guiding ring 170 is disposed between the first passive blades 160 and the second passive blades 180 to connect the first passive blades 160 and the second passive blades 180. As shown in FIG. 5, each of the active blades 150 and each of the first passive blades 160 respectively have a convex surface 151, 161 and a concave surface 152, 162 on the opposite sites of the each blades 150, 160, and the concave surface 152 of each of the active blades 150 faces to the concave surface 162 of each of the first passive blades 160 so that a rotating direction of the active blades 150 is the same as that of the first passive blades 160. Additionally, because of the height of the first airflow guiding ring 170, an accommodating space 171 is formed by an inner wall of the first airflow guiding ring 170. As shown in FIG. 3A, the inner wall of the first airflow guiding ring 170 is parallel to the axis a, but it is not limited thereto. The inner wall of the first airflow guiding ring 170 can be inclined with respect to the axis a.

The first passive blades 160 are connected to the inner wall of the first airflow guiding ring 170. The second passive blades 180 radially encircle the first passive blades 160 and connect to an outer wall of the first airflow guiding ring 170. In this embodiment, each of the first passive blades 160 is overlapped by a neighboring first passive blade 160 in an axial direction to increase air pressure, and at least a portion of the active blades 150 are inserted into the accommodating space 171, as shown in FIG. 3A. With respect to the second passive blades 180, the distance from the distal end of the second passive blades 180 to the axis a is over 30 centimeter, and the length of the second passive blades 180 are larger than that of the first passive blades 160.

Figure 6:
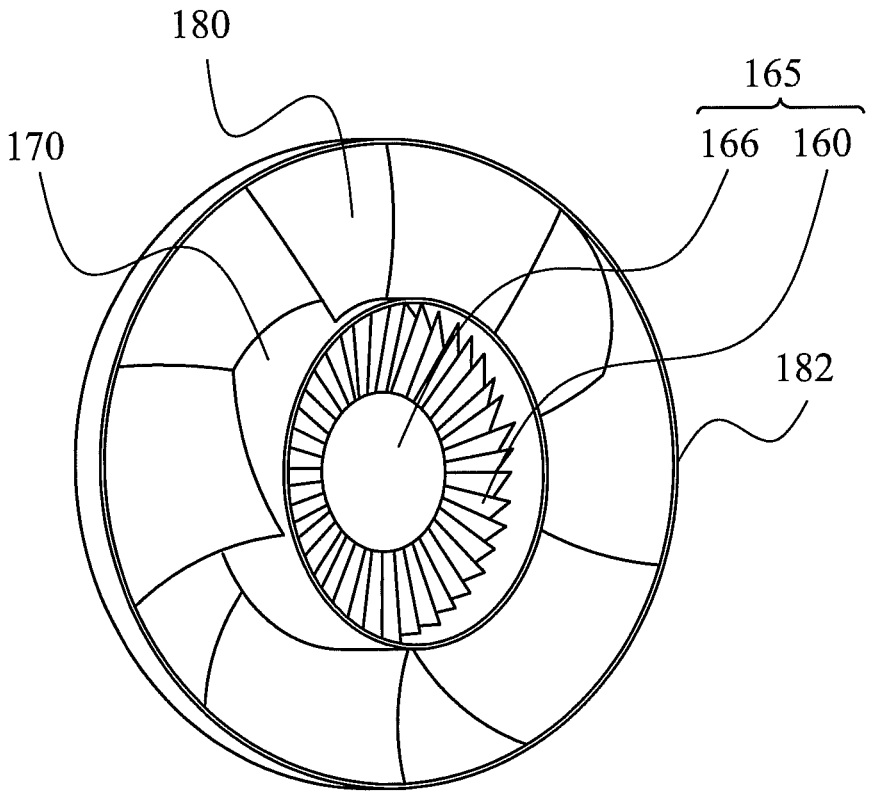
FIG. 6 is a schematic view of partial components of the fan assembly of the first embodiment of the invention.

As shown in FIG. 6, the passive impeller 165 further includes an enforcing ring 182 encircling the outer edges of the second passive blades 180 to enhance structural strength of the second passive blades 180. Overall, the second hub 166, the first passive blades 160, the first airflow guiding ring 170, and the second passive blades 180 are integrally formed as a single piece.

The design theorem of the invention is described below. In the beginning, work, generated by the driving device 130 and of the active blades 150, is:

$$\left(\Delta P + \frac{1}{2}\rho v_a^2 + \frac{1}{2}\rho v_t^2\right)Q_i,$$

where:

$$\frac{1}{2}\rho v_a^2$$

represents a kinetic energy of the airflow in the axial direction a;

$$\frac{1}{2}\rho v_t^2$$

represents a kinetic energy of the airflow in the tangential direction t;

ΔP represents a pressure difference between a pressure in the accommodating space 171 and air pressure; and $Q_i$ represents the amount of the airflow.

Because the airflow, generated by the active impeller 155 accommodated in the first airflow guiding ring 170, in the tangential direction t is impendent by the first airflow guiding ring 170, the kinetic energy of the airflow in the tangential direction t is transformed to the first passive blades 160 causing simultaneous rotation of the first passive blades 160 and the second passive blades 180 see equation (I):

$$\eta\left[Q_i\left(\Delta P + \frac{1}{2}\rho v_t^2\right)\right] \xrightarrow[\text{transferred kinetic energy in the tangential direction } t]{} Q_o\frac{1}{2}\rho v_{ao}^2, \quad \text{(I)}$$

where:

$$\frac{1}{2}\rho v_{ao}^2$$

represents a kinetic energy of the airflow generated by the second passive blades 180 in the axial direction a; and $Q_o$ represents the amount of the airflow generated by the second passive blades 180.

Consequently, by means of transforming the kinetic energy of the airflow in tangential direction t, the amount of airflow $Q_i$ generated by the active blades 150 of the fan assembly 100 of the embodiment is increased into $Q_i+Q_o$ that is:

$$Q_i \xrightarrow[\text{purpose of the invention}]{} Q_i + Q_o.$$

It is understood that by means of the driving device 130 which works at high efficiency and the structural feature of the first airflow guiding ring 170, the passive impeller 165 is propelled by the airflow generated by the active impeller 155 to increase airflow amount. Thus, the purpose of the embodiment to provide a fan assembly which has a light weight and a greater airflow amount is achieved. It is noted that as the fan assembly 100 operates, a heavier weight of the second passive blades 180 causes a slower rotating speed of the first passive blades 160 relative to the active blades 150.

Figure 7:
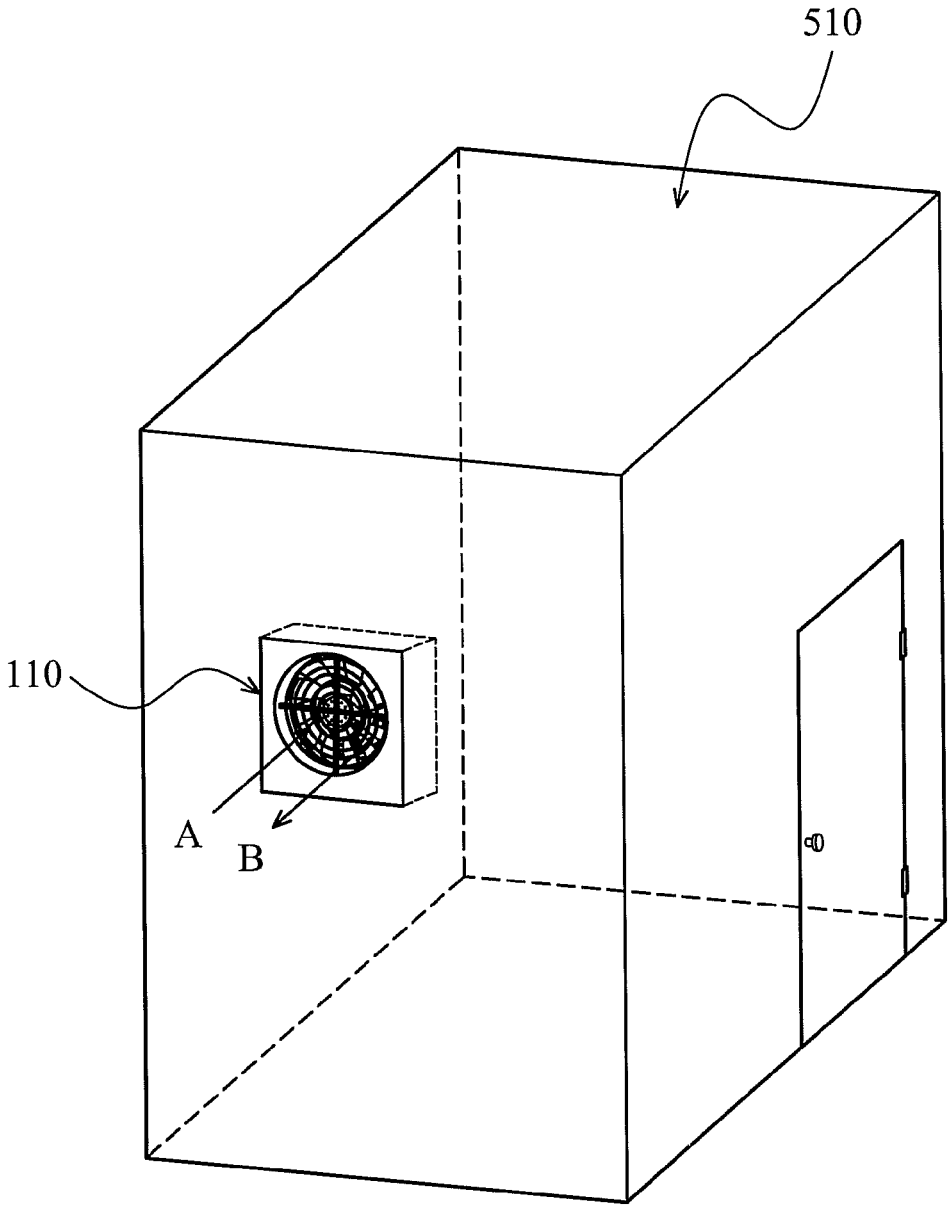
FIG. 7 illustrates a possible application of the invention being applied in a closed room.
Figure 8:
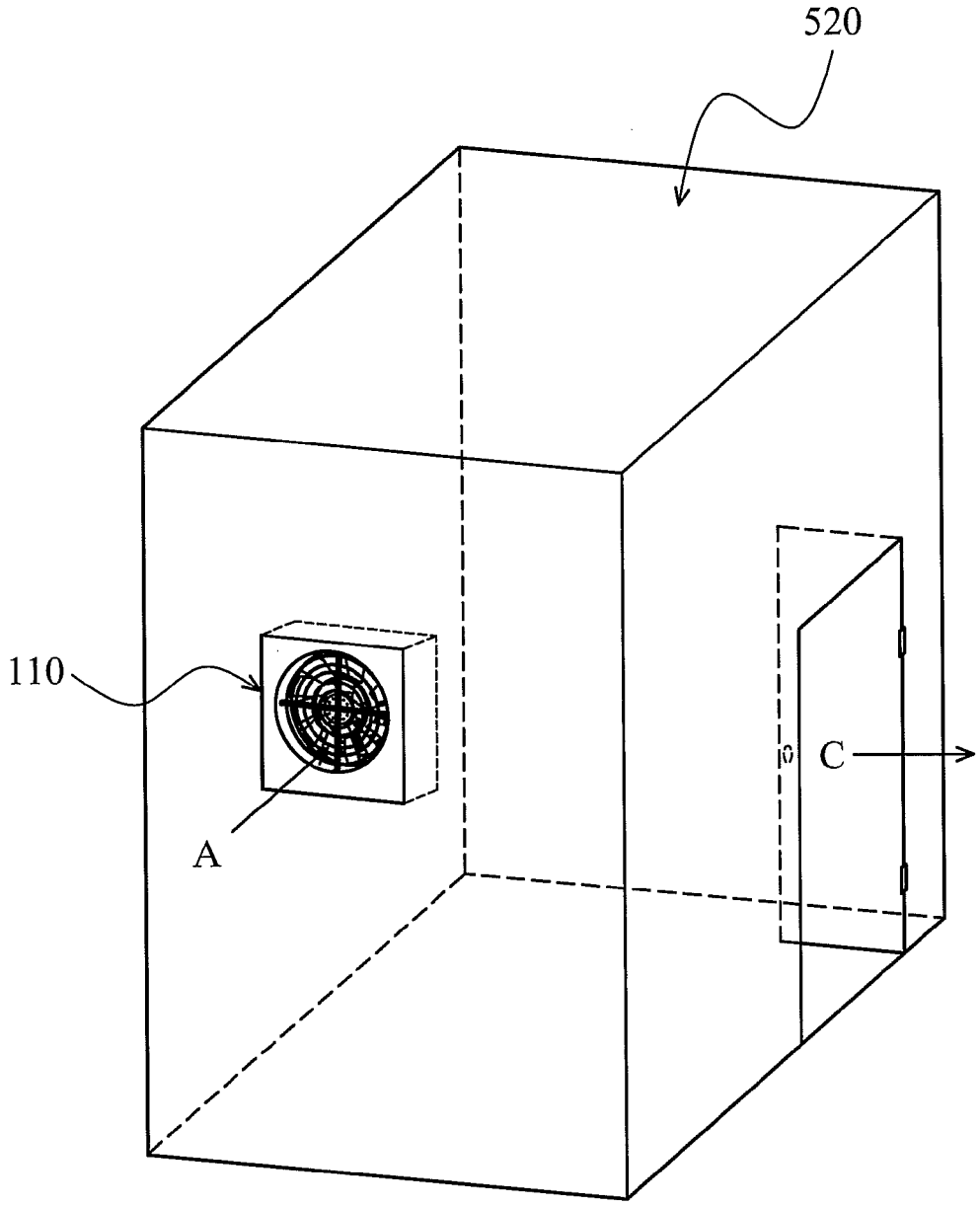
FIG. 8 illustrates another possible application of the invention being applied in an open room.

The application of the invention is described below. FIG. 7 illustrates a possible application of the fan assembly 100 of the invention being applied in a closed room 510, and FIG. 8 illustrates another possible application of the fan assembly 100 of the invention being applied in an open room 520. According to the different desires of a user, the second passive blades 180 of the embodiment are designed to be inclined at an angle which is different from that of the first passive blades 160.

Figure 3B:
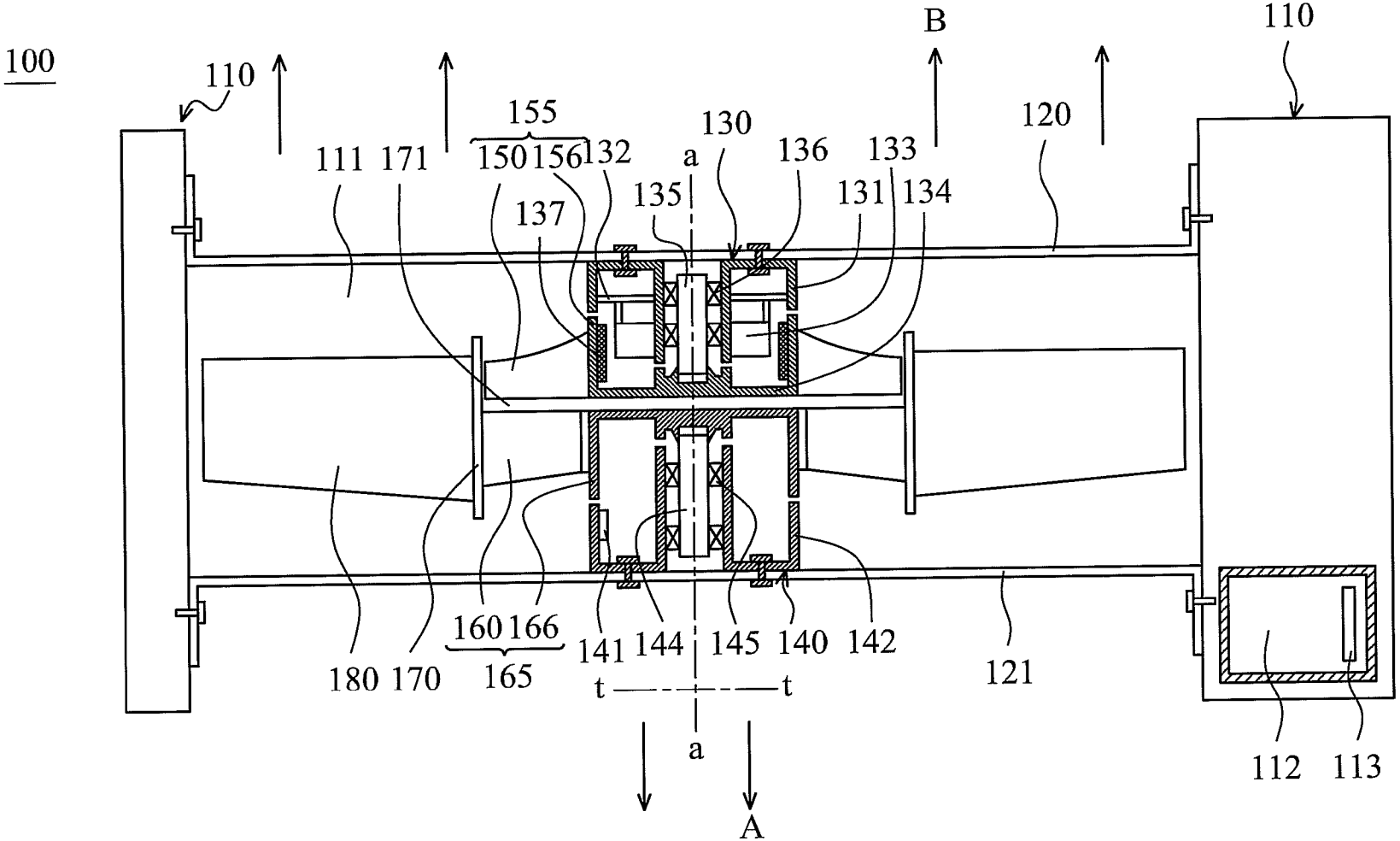

For example, in a case of the fan assembly 100 applied in a closed room 510, the active blades 150 and the first passive blades 160 are designed to be inclined at an angle which is different from that of the second passive blades 180. In this case, mechanical work done to air by the active blades 150 and the first passive blades 160 act along a direction A. On the other hand, mechanical work done to air by the second passive blades 180 act along a direction B. As shown in FIGS. 3B and 7, the direction A is opposite to the direction B, so as to exchange interior the exterior air.

Take another situation for example, in a case where the fan assembly 100 is applied in an opened room 520, because all blades are inclined to an identical or similar angle, mechanical work done to air by the active blades 150, the first passive blades 160, and the second passive blades 180 act along a direction A simultaneously, so as to guide the exterior air into the room 520. Note that although the first passive blades 160 and the second passive blades 180 rotate in the same direction, a user can cleverly modify the design to satisfy different desires.

Figure 9:
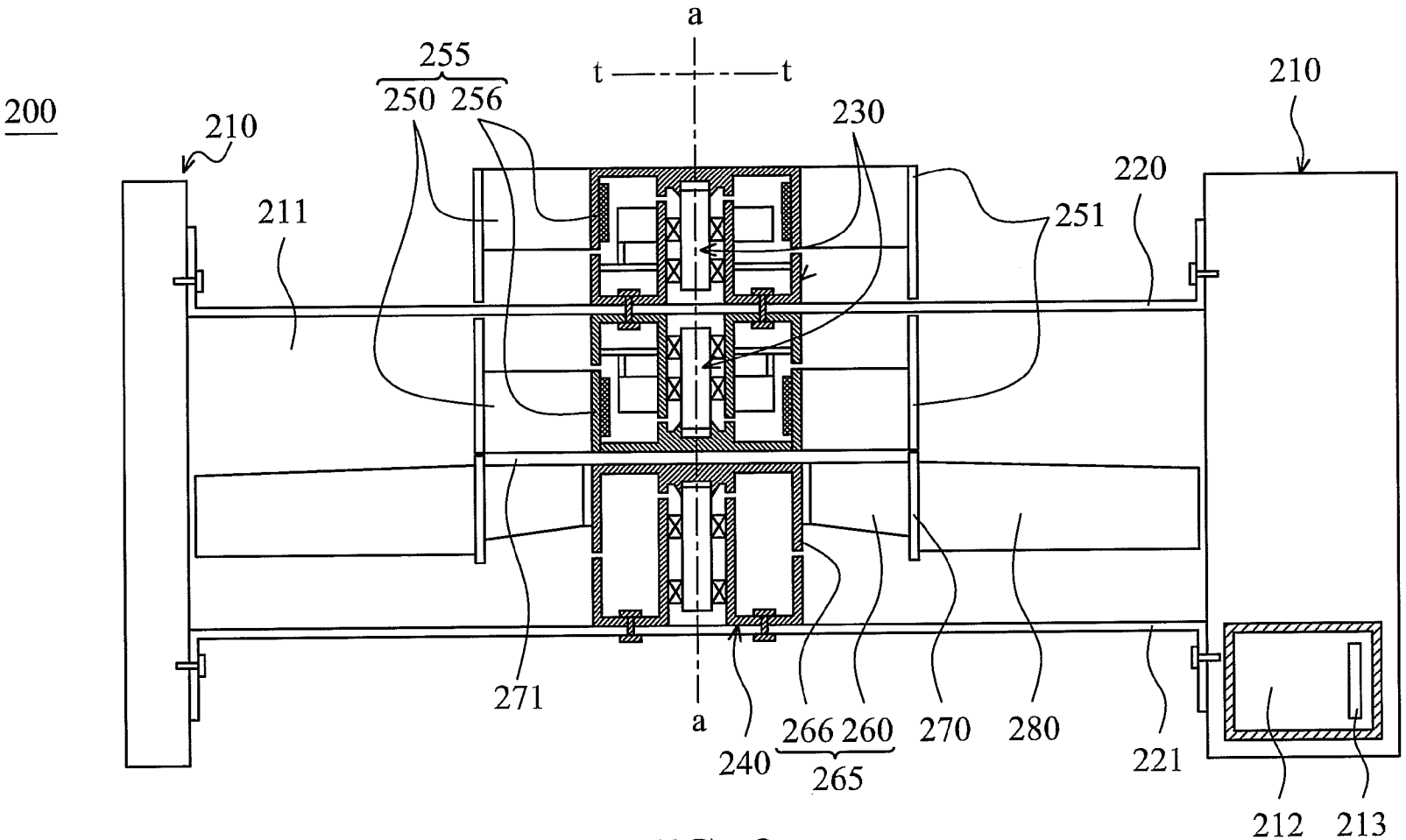
FIG. 9 is a sectional schematic view of a fan assembly of a second embodiment of the invention.
Figure 10:
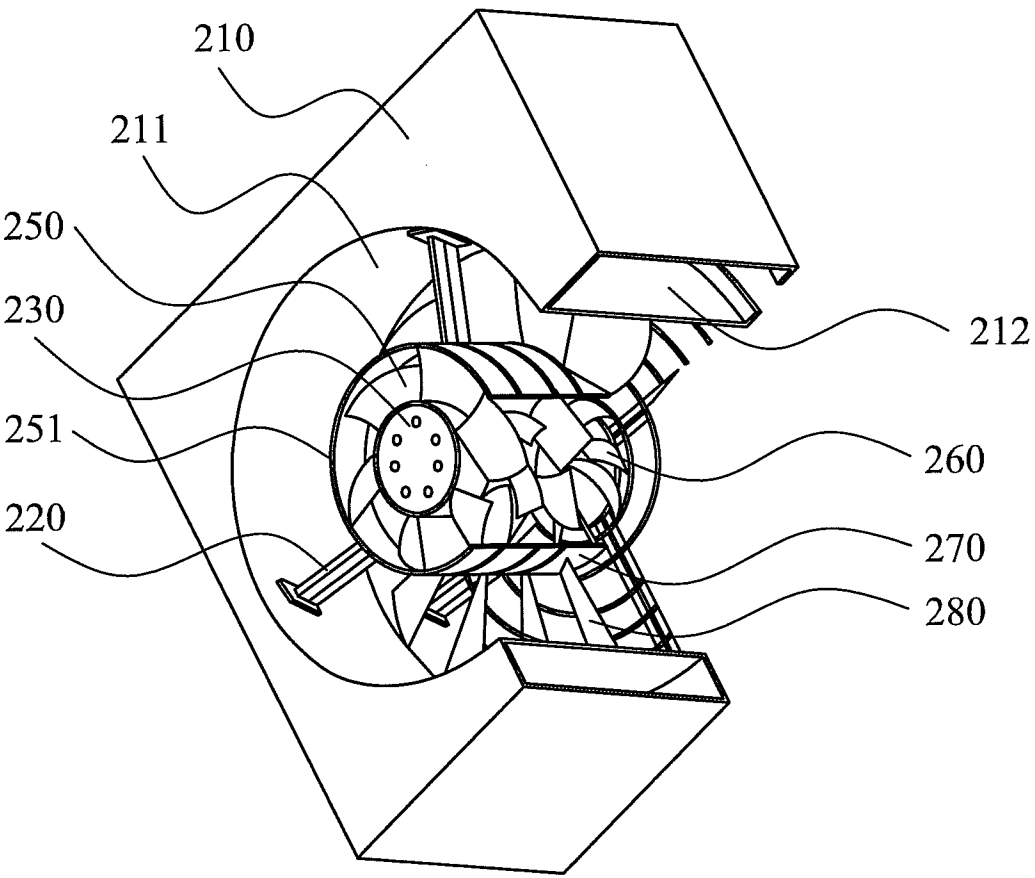
FIG. 10 is a schematic view of the fan assembly of the second embodiment of the invention.

Please refer to FIGS. 9 and 10, wherein FIG. 9 is a sectional schematic view of a fan assembly 200 of a second embodiment of the invention, and FIG. 10 is a schematic view of the fan assembly 200 of the second embodiment of the invention. In order to clearly present connecting relationships between the components, only parts of the housing 210, the first airflow guiding ring 270, and the second airflow guiding ring 251 are shown. In this embodiment, the fan assembly 200 includes a housing 210, a first frame 220, a second frame 221, two active impellers 255, a passive impeller 265, two driving devices 230, a supporting device 240, a first airflow guiding ring 270, and a plurality of second passive blades 280.

The housing 210 has an air-flowing channel 211 penetrating through a substantially central portion thereof, and a chamber 212 is disposed therein for receiving at least one electronic element 213. The first frame 220 is disposed on one end of the air-flowing channel 211, and the second frame 221, opposite to the first frame 220, is disposed on another end of the air-flowing channel 211. The first frame 220 and the second frame 221 are fixed to the housing 210 by screw arrangement.

In this embodiment, two driving devices 230 are served to provide power for the fan assembly 200, and the first frame 210 is disposed between the two driving devices 230, combined in series. The supporting device 240, corresponding to the driving device 230, is disposed at the second frame 221, and the driving devices 230 and the supporting device 240 are disposed along an axis a, as shown in FIG. 9.

Each of the active impeller 255 includes a plurality of active blades 250, a first hub 256, and a second airflow guiding ring 251. The passive impeller 265 includes a plurality of first passive blades 260 and a second hub 266. The active blades 250 are disposed on an outer wall of the first hub 256, and the first passive blades 260, facing the active blades 250, are disposed on an outer wall of the second hub 266, wherein the active blades 250 and the first passive blades 260 correspond to each other in an axial direction.

Each of the driving devices 230 has an independent active impeller 255 disposed thereon, and the passive impeller 265 is disposed on the supporting device 240. The second airflow guiding rings 251 are connected to the active blades 250 respectively. Because of the height of the first airflow guiding ring 270, an accommodating space 271 is formed by an inner wall of the first airflow guiding ring 270. The first passive blades 260 are pivoted on the supporting device 240 and disposed in the accommodating space 271, wherein the first passive blades 260 are connected to the inner wall of the first airflow guiding ring 270. The second passive blades 280 are connected to the outer wall of the first airflow guiding ring 270, and dimensions of the each second passive blades 280 are larger than that of the each first passive blades 260. Preferably, the first airflow guiding ring 270 and the second airflow guiding rings 251 are disposed along the axis a and connected in a manner of a series, and the diameter of the first airflow guiding ring 270 and the second airflow guiding rings 251 are identical, so as to formed a continuous airflow guiding channel.

As the fan assembly 200 operates, the driving devices 230 actuate the active impellers 255. By means of the first airflow guiding ring 270 and the second airflow guiding rings 251, the passive impeller 265 is propelled by the air pressure generated by the active impellers 255, while at the same time the second passive blades 280 produce work on air and generate airflow. Thanks to the arrangement of the first airflow guiding ring 270 and the second airflow guiding rings 251, the purpose to provide a fan assembly which has a light weight and greater airflow amount in a condition that the driving devices 230 works at high efficiency can be achieved.

It is noted that in order to increase the utilization of wind energy, the second airflow guiding rings 251 are connected to the active blades 250. Because of the second airflow guiding rings 251, the airflow generated by the active impeller 255 is guided into the accommodating space 271, so that the kinetic energy of the airflow in the tangential direction t can be transformed into the kinetic energy of the airflow in the axial direction a therein.

As previously noted, the characteristic feature of the fan assembly of the invention is that the tangential airflow generated by the active blades is utilized to rotate the first and second passive blades, wherein a heavier weight of the second passive blades causes a slower rotating speed relative to the active blades. Specifically, the kinetic energy of the airflow in the tangential direction, with less attribution for heat dissipation, is reused to propel the other blades which have larger sizes; thus, the driving device, i.e. an electrical motor, can work at high efficiency, and the performance of the fan assembly is increased.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan assembly, comprising:

a housing having an air-flowing channel;

a first frame disposed at one end of the air-flowing channel;

a second frame, opposite to the first frame, disposed at another end of the air-flowing channel;

at least one driving device disposed on the first frame;

a supporting device disposed on the second frame;

an active impeller, actuated by the driving device, comprising a first hub, and a plurality of active blades;

a passive impeller, disposed on the supporting device, comprising a second hub, and a plurality of first passive blades, wherein when airflow is generated by the active impeller, the passive impeller is propelled by the airflow, wherein the passive impeller further comprises a plurality of second passive blades encircling the first passive blades, wherein the passive impeller further comprises a first airflow guiding ring disposed between the first passive blades and the second passive blades to connect the first passive blades to the second passive blades, wherein the first passive blades are connected to an inner wall of the first airflow guiding ring and the second passive blades are connected to an outer wall of the first airflow guiding ring, wherein an accommodating space is formed by the inner wall of the first airflow guiding ring, and at least a portion of the active blades are inserted into the accommodating space.

2. The fan assembly as claimed in claim 1, wherein the inner wall of the first airflow guiding ring is parallel to or inclined with respect to an axis.

3. The fan assembly as claimed in claim 1, wherein the active impeller further comprises a second airflow guiding ring encircling the outer edges of the active blades.

4. The fan assembly as claimed in claim 1, wherein the second hub, the first passive blades, the second passive blades, and the first airflow guiding ring are integrally formed as a single piece.

5. The fan assembly as claimed in claim 1, wherein the active blades and the first passive blades correspond to each other in an axial direction.

6. The fan assembly as claimed in claim 1, wherein the second passive blades encircle radially the first passive blades.

7. The fan assembly as claimed in claim 1, wherein the passive impeller further comprises an enforcing ring encircling the outer edges of the second passive blades.

8. The fan assembly as claimed in claim 1, wherein lengths of the second passive blades are larger than lengths of the first passive blades.

9. The fan assembly as claimed in claim 1, wherein a direction of the airflow generated by the second passive blades is different from or the same as a direction of the airflow generated by the active blades.

10. The fan assembly as claimed in claim 1, wherein each of the first passive blades is overlapped by a neighboring first passive blade in an axial direction.

11. The fan assembly as claimed in claim 1, further comprising a plurality of driving devices, combined in series, and a plurality of active impellers, wherein each of the driving devices has an independent active impeller disposed thereon.

12. The fan assembly as claimed in claim 11, wherein the first frame is disposed between the driving devices.

13. The fan assembly as claimed in claim 1, wherein the housing further comprises a chamber for receiving at least one electronic element.

14. The fan assembly as claimed in claim 1, further comprising a sensor, disposed on the supporting device, for detecting a rotating speed of the passive impeller or a current speed of the airflow generated by the passive impeller.

15. The fan assembly as claimed in claim 1, wherein the driving device comprises a first base, a circuit board, a stator, a first shaft, a magnetic component, and at least one first bearing, wherein the active blades are disposed on an outer wall of the first hub, the magnetic component is disposed on an inner wall of the first hub, the first shaft and the first bearing are disposed in a space constructed by the first hub and the first base, and the first base is fixed to the first frame by screw arrangement.

16. The fan assembly as claimed in claim 1, wherein the supporting device comprises a second base, a second shaft, and at least one second bearing, wherein the first passive blades are disposed on an outer wall of the second hub, the second shaft and at least one of the second bearings are disposed in a space constructed by the second hub and the second base, and the second base is fixed to the second frame by screw arrangement.

17. The fan assembly as claimed in claim 1, wherein a gap is constituted between the active impeller and the passive impeller resulting in no connection between the active impeller and the passive impeller.

18. The fan assembly as claimed in claim 1, wherein the first frame or the second frame is fixed to the housing by screw arrangement.

19. The fan assembly as claimed in claim 1, wherein the first frame or the second frame is a protective cover, a rib, or stator blades.

20. The fan assembly as claimed in claim 1, wherein each of the active blades and each of the first passive blades respectively has a concave surface and a convex surface on opposite sites, and the concave surface of the active blades face the concave surface of the first passive blades.

21. The fan assembly as claimed in claim 1, wherein a rotating direction of the active blades is the same as that of the first passive blades.

* * * * *